US005524649A

United States Patent [19]

Suh

[11] Patent Number: 5,524,649

[45] Date of Patent: Jun. 11, 1996

[54] DEVICE FOR FORMING EYELASHES

[76] Inventor: Jung-Joo Suh, 303-1005 Jugong Apt., Chang-ldong, Dobong-ku, Seoul, Rep. of Korea

[21] Appl. No.: 339,456

[22] Filed: Nov. 14, 1994

[51] Int. Cl.[6] ..... A45D 2/48

[52] U.S. Cl. ..... 132/217; 132/216

[58] Field of Search ..... 132/216, 218, 132/213, 217, 223; 401/129, 119

[56] References Cited

U.S. PATENT DOCUMENTS

| | | | |
|---|---|---|---|
| 2,004,046 | 6/1935 | Glaser et al. | 132/217 |
| 2,584,668 | 2/1952 | Brown | 132/217 |
| 3,828,803 | 8/1974 | Windsor | 132/216 |
| 5,097,598 | 3/1992 | Andreula | 30/233 |

*Primary Examiner*—Cary E. O'Conner
*Assistant Examiner*—Philogene Pedro
*Attorney, Agent, or Firm*—Hedman, Gibson & Costigan

[57] ABSTRACT

The present invention provides a device for forming eyelashes comprising a support member having a knob and a longitudinal slot, two guide rail portions upwardly extending from an upper end of the knob, and a forming part which connects both ends of the guide rail portions and has a shape for supporting the eyelashes and forming them to a desired angle; an actuating member including a lower portion having a lower end pivotably attached to the slot, and an upper portion having one end flexibly connection to an upper end of the lower portion via a first middle portion and another end flexibly connected via a second middle portion to a slide having a pressure pad attached thereto and a resilient member one end of which is connected to the support member and another end of which is connected to the actuating member; whereby when the lower portion of the actuating member is pressed against the resilient member, the slide is moved along the guide rail portion, and the pressure pad and the forming part cooperate to form the eyelashes to the desired angle.

2 Claims, 1 Drawing Sheet

DEVICE FOR FORMING EYELASHES

FIELD OF THE INVENTION

The present invention relates to a device for forming eyelashes and more specifically, to the device which is more convenient to use when forming the eyelashes to an angle.

BACKGROUND OF THE INVENTION

Referring to FIG. 1, there is illustrated a typical device for forming eyelashes which a woman uses when forming her eyelashes upwardly to make them beautiful. The device has a scissors-like shape, and therefore if the device is operated by inserting a finger into a knob 1, a slide 3 having a pressure pad 2 attached thereto is moved upwardly along a guide rail 4.

That is to say, by the force transferred to the slide 3 through the knob 1 and a lever 5, the slide 3 is moved upwardly along the rail 4, and thereby the pressure pad 2 of the slide 3 is pressurized against a support member 6 to form the eyelashes upwardly to an angle.

Typically the above-mentioned device is made from steel such as stainless steel, or plastic. In the first case, although the steel device provides structural rigidity, it is uncomfortable due its coldness upon contact with the user's skin. In the second case, although the problem associated with coldness is largely solved, the device is apt to be broken down by the fact that the pressure pad attached to the tip of the slide applies extra-pressure to the support member when excessive force is applied to the knob.

Also, the device of the prior art increases manufacturing cost due to its structural complexity: and since both the thumb and index finger have to be used, operation of the device is troublesome.

OBJECT OF THE INVENTION

Therefore, the present invention has been made to overcome the disadvantages of the conventional eyelashes forming device, and the object of the present invention is to provide a device for forming eyelashes which has compact structure and is convenient to use.

SUMMARY OF THE INVENTION

To achieve the above-mentioned object of the present invention, there is provided a device for forming eyelashes which comprises of a support member having a knob and a longitudinal slot, two guide rail portions upwardly extending from an upper end of the knob, and a forming part which connects both ends of the guide rail portions and has a shape for supporting the eyelashes and forming them to a desired angle; an actuating member including a lower portion having a lower end pivotably attached to the slot, and an upper portion having one end flexibly connected to an upper end of the lower portion via a first middle portion and another end flexibly connected via a second middle portion to a slide having a pressure pad attached thereto; and a resilient member one end of which is connected to the support member and another end of which is connected to the actuating member; whereby when the lower portion of the actuating member is pressed against the resilient member, the guide is moved along the guide rail portions, and the pressure pad and the forming part cooperate to form the eyelashes to the desired angle.

According to another aspect of the invention, the support member has a first projection beneath the lower portion thereof and the actuating member has a second projection on the slot thereof, the two opposing projections cooperating with each other to limit the movement of the slide along the guide rail portions to such an extent that the lower portion of the actuating member is pressed toward the slot until another projection abuts against the one projection.

By the above features of the invention, the device of the subject invention is compact in structure and convenient to use.

Other objects and advantages of the subject invention will be readily understood to those skilled in the art from the following description of a preferred embodiment when taken in conjunction with the accompanying drawings wherein:

DETAILED DESCRIPTION OF THE PREFERRED EMBODIMENT

Figure 1:
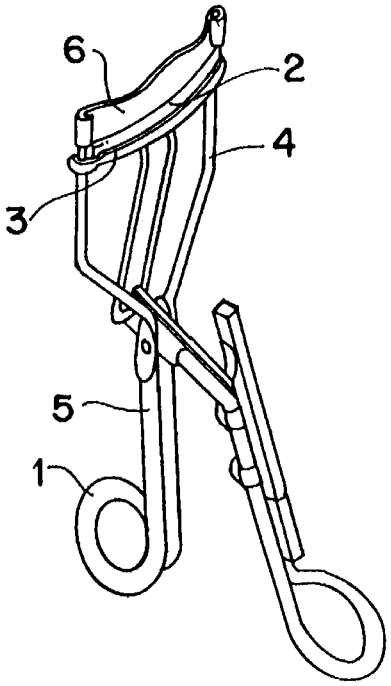
FIG. 1 (PRIOR ART)
FIG. 1 is a schematic perspective view showing a device for forming eyelashes having scissors-like shape of the prior art.
Figure 2:
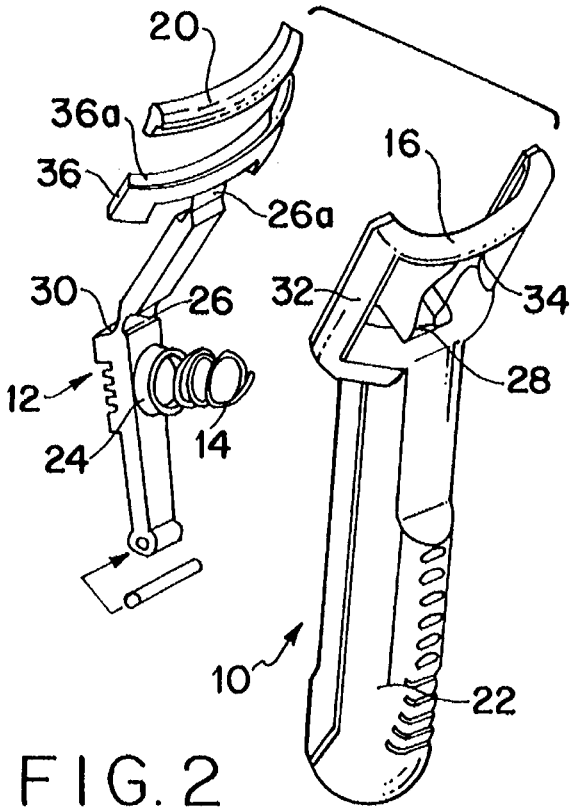
FIG. 2 is an exploded view showing the entire construction of a device for forming eyelashes of the present invention.
Figure 3A:
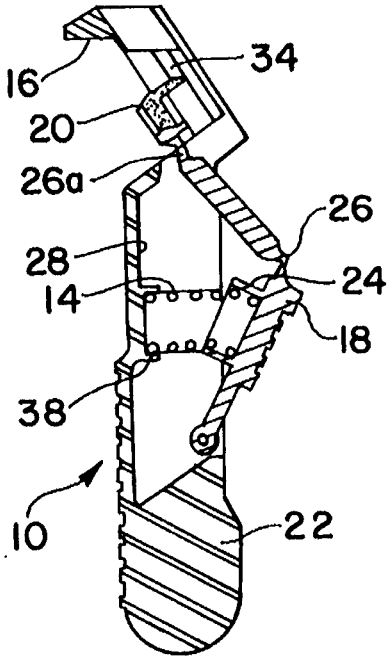
FIGS. 3A and 3B are cross-sectional views each showing the operation of the device when one end of an actuating member is released and pressed.
Figure 3B:
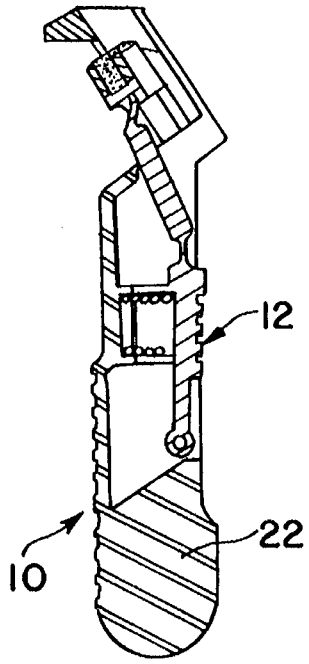

Referring now to FIG. 2, a device for forming eyelashes according to the present invention has a support member 10, an actuating member 12 and a resilient member, for example, a spring 14, disposed therebetween. There is defined a longitudinally extending slot 28 on one side of the support member 10, and a knob 22 is formed on the opposite side of the support member 10.

From the upper end of the support member 10, two rod portions 32 are upwardly integrally extended, both ends of which are connected to each other by a forming part 16. Each rod portion 32 is formed with a guide rail portion 34, and the forming part 16 has the shape for supporting the eyelashes and forming them to a desired angle. From the bottom surface of the slot 28 is upwardly projected a first circular projection 38.

The actuating member 12 includes a lower portion 18 having a lower end pivotably attached to two side walls of the slot 28 by means of a pin 22A; and an upper portion 30 having one end flexibly connected to an upper end of the lower portion 18 via a first middle portion 26 and another end flexibly connected to a slide 36 via a second middle portion **26*a*. The slide 36 is rounded to be mated with the shape of the forming part 16 and can be moved along two guide rail portions 34 of the support member 10. On an upper surface 36, there is defined a groove 36*a*, into which a pressure pad 20 made of silicon is fitted. Opposed to the first circular projection 38 of the support member 10, a second circular projection 24 is downwardly projected from the inner surface of the lower portion 18 of the actuating member 12**.

The lower portion 30 18 and the upper portion of the actuating member 12 are connected to each other by the flexible middle portion 26 which has a thickness less than other portions to create flexibility thereof. Accordingly, when the lower portion 18 of the actuating member 12 is released, the flexible middle portion 26 is maintained in a bent state; and when the lower portion 18 of the actuating member 12 is pressed, the slide 36 is moved along the two guide rail portions 34, whereby the flexible middle portion 26 is stretched out to be positioned in a substantial parallel relationship with the slot 28 of the support member 10.

One end of the spring 14 is fixedly attached to the interior of the first circular projection 38 in the support member 10 and another end of the spring 14 is fixedly attached to the interior of the second circular projection 24 in the lower portion 18 of the actuating member 12. The opposing projections 38, 24 cooperate with each other to limit the movement of the slide 36 along the guide rail portions 34 to such an extent that the lower portion 18 of the actuating member 12 is pressed toward the slot 28 until the projection 24 abuts against the projection 38.

According to above-mentioned structure of the device of the present invention, when the lower portion 18 of the actuating member 12 is pressed, the slide 36 flexibly attached upper portion of the actuating member 12 moves upwardly along the guide rail portions 34 of the support member 10 to form the eyelashes positioned between the forming part 32 and the pressure pad 20 into a desired angle. Then, if the lower portion 18 is released, the slide 36 returns to its original position by the elastic force of the spring 14. A person skilled in the art will readily understand that the engaging surfaces of the forming part 16 and the pressure pad 20 are shaped in an appropriate manner to form the eyelashes to a desired angle.

Therefore, the present invention provides a device for forming eyelashes which is compact in structure and convenient to use.

Although the present invention has been described and illustrated in conjunction with a preferred embodiment, those skilled in the art will be readily understand that the present invention can be changed and modified without departing from the spirit and scope of the invention as defined in appended claims.

What is claimed is:

1. A device for forming eyelashes comprising:

a support member having a knob and a longitudinal a, two guide rail portions upwardly extending from an upper end of the knob, and a forming part which connects both ends of the guide rail portions and has a shape for supporting the eyelashes and forming them to a desired angle;

an actuating member including a lower portion having a lower end pivotably attached to the slot, and an upper portion having one end flexibly connected to an upper end of the lower portion via a first middle portion and another end flexibly connected via a second middle portion to a slide having a pressure pad attached thereto; and a resilient member one end of which is connected to the support member and another end of which is connected to the actuating member;

whereby when the lower portion of the actuating member is pressed against the resilient member, the slide is moved along the guide rail portions, and the pressure pad and the forming part cooperate to form the eyelashes to the desired angle.

2. A device for forming eyelashes as claimed in claim 1, wherein the support member has a first projection beneath the lower portion thereof and the actuating member has a second projection on the slot thereof the two opposing projections cooperating with each other to limit the movement of the slide along the guide rail portions to such an extent that the lower portion of the actuating member is pressed toward the slot until the second projection abuts against the first projection.

* * * * *